United States Patent [19]

Morlock et al.

[11] 4,196,668

[45] Apr. 8, 1980

[54] STOPPING OPERATING ENEMY VEHICLES, VESSELS AND AIRCRAFTS

[76] Inventors: Günter E. Morlock, Christofstrasse 19, D-75 Karlsruhe 41; Johannes P. A. Wiesemes, St. Magdalenenstrasse 74, D-502 Frechen, both of Fed. Rep. of Germany

[21] Appl. No.: 930,426

[22] Filed: Aug. 2, 1978

Related U.S. Application Data

[63] Continuation-in-part of Ser. No. 742,217, Nov. 15, 1976, abandoned.

[30] Foreign Application Priority Data

Nov. 18, 1975 [DE] Fed. Rep. of Germany ..... 2551668

[51] Int. Cl.[2] ..... F42B 13/00; F42B 23/04

[52] U.S. Cl. ..... 102/56 R; 102/8; 89/1 A; 264/51

[58] Field of Search ..... 102/8, 56 R, 67, 37.6; 89/1 A

[56] References Cited

U.S. PATENT DOCUMENTS

| | | | |
|---|---|---|---|
| 3,110,552 | 11/1963 | Voelker | 264/45.2 |
| 3,150,387 | 9/1964 | Look et al. | 264/45.2 |
| 3,313,112 | 4/1967 | Reichert et al. | 264/46.6 |
| 3,329,750 | 7/1967 | Growald | 264/45.2 |
| 3,536,010 | 9/1968 | Moldeus | 102/37.6 |

*Primary Examiner*—Verlin R. Pendegrass

[57] ABSTRACT

A device to stop operating enemy vehicles, vessels and aircrafts: A container as part of an adequate transport mean contains such substances which when getting in contact develop rigid plastics foam with a delayed hardening time. The plastics foam expelled via spray nozzles hardens quickly at elevated temperatures and blocks movable parts of traversing enemy vehicles e.g. tracks of tanks and seals the air-supply of combustion engines and hinders the use of optical devices. If a conducting plastics foam is used outer parts of electronic devices e.g. antennas are disabled.

A large cloud of small droplets consisting of still soft plastics foam is generated in the flight-path of an aircraft whereby the droplets are sucked into the engine where the hardening process is rapidly accelerated by the high temperature therein so that the engine is blocked by the hardened rigid plastics foam.

5 Claims, 3 Drawing Figures

1
12
6
13
14
7
15
2
2
7
11
16
11
8
8
9
9
10

1
2
4
3
5

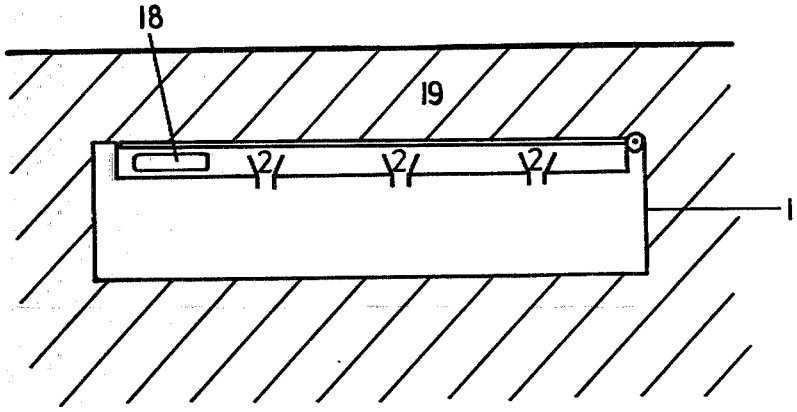
FIG.2
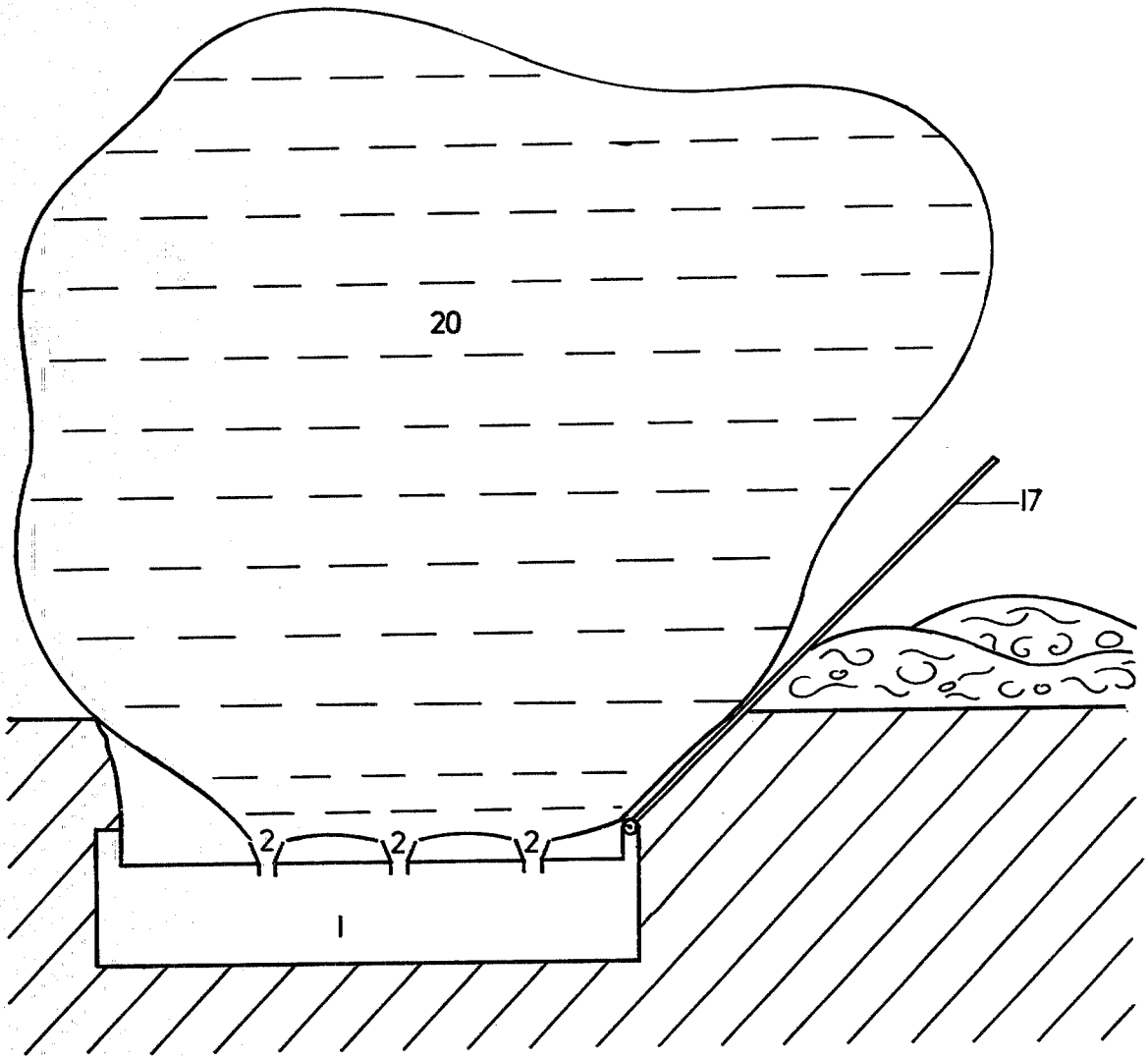

STOPPING OPERATING ENEMY VEHICLES, VESSELS AND AIRCRAFTS

This application is a continuation-in-part of application Ser. No. 742,217 filed Nov. 15, 1976 and now abandoned.

BACKGROUND OF THE INVENTION

There are a lot of various conventional weapons to destroy enemy vehicles, vessels or aircrafts. It is well known that conventional explosive projectiles have small cross-sections for hits onto armored vehicles. Normally a direct hit is necessary for the destruction. Therefore a great number of projectiles and a lot of guiding- and aiming-devices are needed to ensure a success. The reuse of hit vehicles by home forces is normally impossible.

It was the purpose of the invention to develop a cheap device by which enemy vehicles, vessels and aircrafts can be stopped operating with greater efficiency by substantial enlargement of the cross-section for hitting so that the expectancy of hitting per projectile is strongly increased.

BRIEF DESCRIPTION OF THE DRAWINGS

FIG. 2 shows the container used as a landmine buried and in function.

DESCRIPTION OF THE INVENTION

The device operates as follows:

The device to stop operating enemy vehicles consists of a container (1) which is part of an adequate transport mean e.g. a guided or unguided missile, a shell, a bomb, or the like and is thus transported to the target or to the nearby ground.

Figure 1:
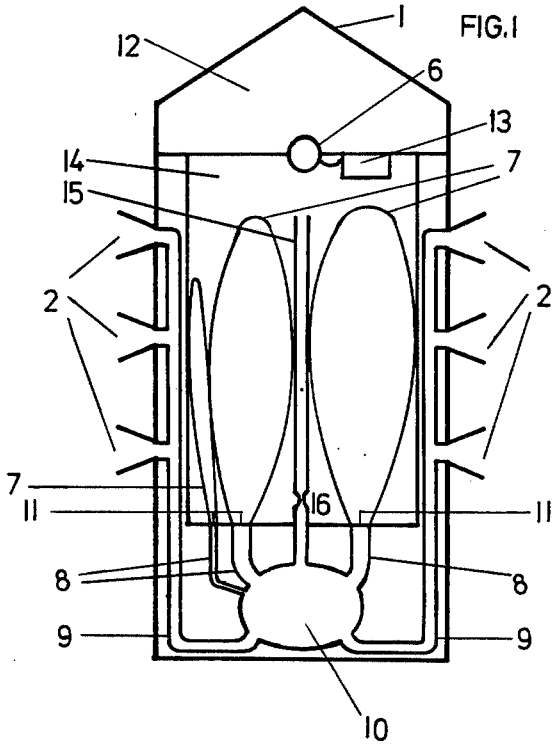
FIG. 1 shows the inner structure of the container.

The container (1) contains (FIG. 1):

- a built-in gas tank (12) with pressurized gas e.g. a halocarbon to built up a high pressure in the main volume (14) and to serve as a blowing agent and
- a striker (6) or a priming detonator (6) or a valve (6) to open the gas tank (12) and
- a releasing device (13) to trigger the striker (6) or the priming detonator (6) or the valve (6) and
- in the main volume (14) bags (7) filled with different substances e.g. a polyisocyanate, a polyhydroxyl compound, a catalyst which when getting in contact develop rigid plastics foam e.g. a polyurethane with a delayed hardening time at ambient temperature and with a short hardening time at elevated temperatures and
- a mixing chamber (10) connected with the bags (7) by tubes (8) originally closed by foils (11) as predetermined breaking points and
- a tube (15) with a venturi (16) from the main volume (14) to the mixing chamber (10) and
- spray nozzles (2) in the outer wall of the container (1) connected with the mixing chamber (10) by connecting tubes (9).

The releasing device (13) triggers the striker (6) or the priming detonator (6) or the valve (6) which opens the gas tank (12). The gas is released into the main volume (14). The gas presses the foam producing substances out of the bags (7) through the tubes (8) into the mixing chamber (10) whereby the closing foils (11) are destroyed by rupture. A part of the gas streams—pressure reduced—via the tube (15) with the venturi (16) into the mixing chamber (10) and blows as blowing agent the plastics foam. The venturi (16) ensures a higher pressure in the main volume (14) than it is in the mixing chamber (10). This pressure difference is necessary to maintain the pressing of the foam producing substances out of the bags (7) into the mixing chamber (10). The plastics foam produced in the mixing chamber (10) is still soft and is expelled by the overpressure out of the mixing chamber (10) via the connecting tubes (9) through the spray nozzles (2) to the environment.

A lot of plastics foam is released on the target when hit or on the nearby ground so that hit or traversing vehicles are fully or partly covered with the still soft plastics foam. The heat of friction e.g. of moving tank tracks accelerates rapidly the hardening process so that such moving parts are blocked by the hardening rigid plastics foam.

Further the still soft plastics foam is sucked into the air-inlet of combustion engines of vehicles or vessels and seals the air supply e.g. the air filters. Further the still soft plastics foam covers the outer parts of optical devices and hinders the use of them. If plastics foams with different more or less delayed hardening times are used the efficacy is extended over a longer period of time. Conducting plastics foam disables the outer parts of electronic devices e.g. antennas by short-circuits and by Faraday shielding. Such a foam is made conducting by the integration of highly dispersed metal powder e.g. of aluminum.

Instead of transporting to the target the container (1) can be used as a land mine (FIG. 2). The container is buried in the soil and protected with a spring cover (17) and a soil layer (19). The spring cover (17) is opened by an explosive charge (18) so that the soil layer (19) is removed and the produced plastics foam is released to the environment.

Figure 3:
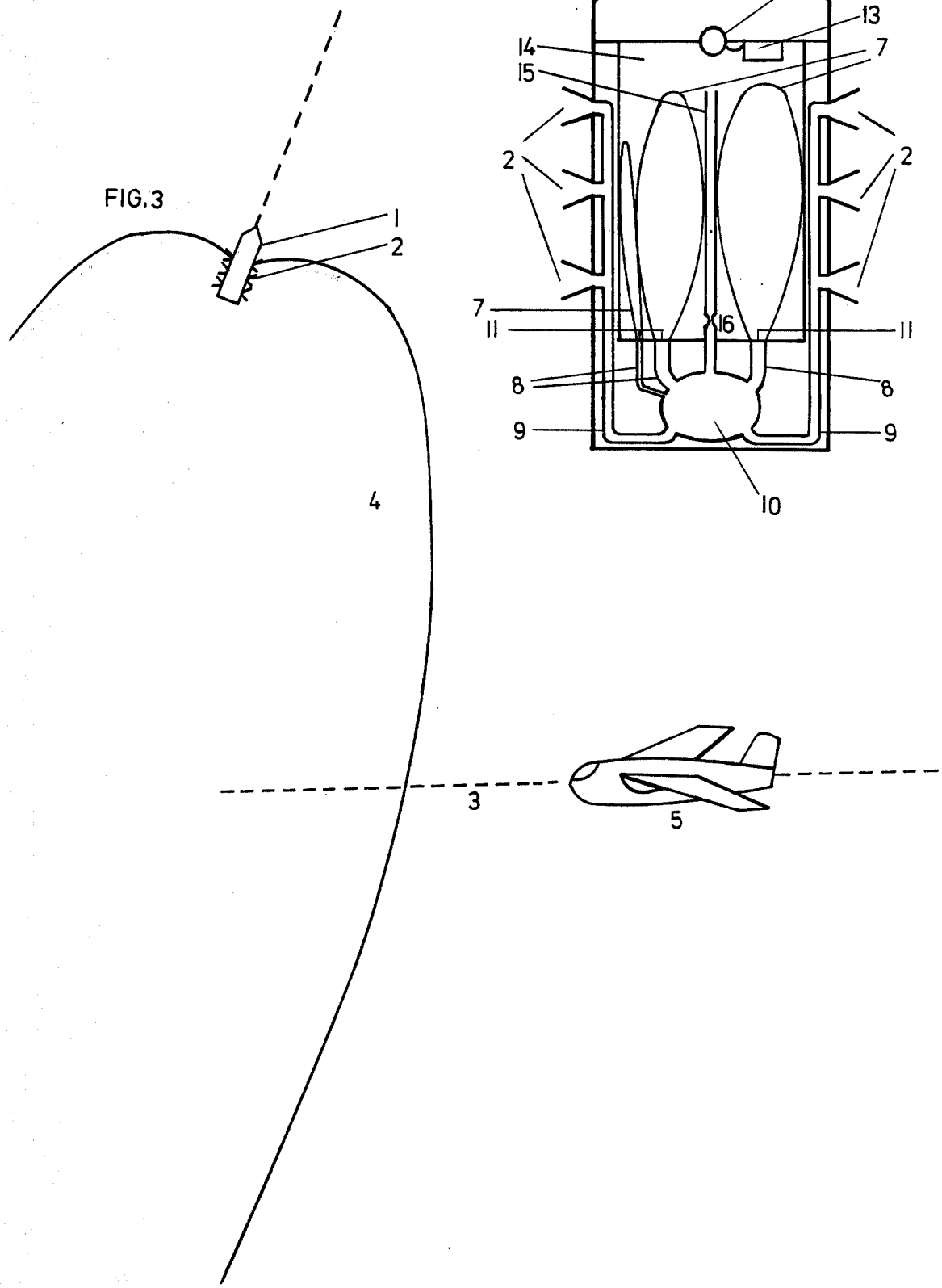
FIG. 3 shows the container having generated a large cloud of still soft plastics foam in the flight-path of an aircraft.

When fighting enemy aircraft the container (1) is transported by an adequate transport means e.g. a guided or unguided missile, a shell, or the like in the vicinity of the flight-path (3) of an enemy aircraft (5) (FIG. 3). In the vicinity of the flight-path (3) the still soft plastics foam is expelled through the spray nozzles (2) in form of a large cloud of small droplets (4) so that enemy aircraft with high velocity can hardly fly round the large cloud of small droplets (4). The small droplets are sucked into the air-inlet of the engine of the flying through aircraft. The high temperature in the engine accelerates rapidly the hardening process of the plastics foam so that the hardened rigid plastics foam blocks the engine.

ADVANTAGES OF THE DESCRIBED INVENTION

The use of the container as a parachute missile or as a parachute shell or as a parabomb permits fighting an area target or to generate a cloud barricade against enemy aircraft. So the expectancy of hitting enemy targets is strongly increased by substantial enlarging of the cross-section. Enemy vehicles loose their mobility when movable parts e.g. tracks of tanks are blocked. When the occasion arises the captured vehicles e.g. tanks can be reused by home forces. Combustion engines of enemy vehicles or vessels are stopped operating or are decreased in their efficiency when the necessary air supply is stopped or decreased. The outer parts of optical devices are covered with plastics foam which hinders the use of them.

The use of conducting plastics foam leads to short-circuits and to Faraday shielding of electronic devices e.g. antennas. An interruption of wireless communications and an unserviceability of electronic observation devices e.g. radar antennas can strongly decrease the enemy fighting strength. Cloud barricades of still soft plastics foam droplets can deter low flying enemy aircrafts from flying under the radar observation of home forces.

What is claimed is:

1. An apparatus for use against enemy vehicles comprising a container adapted to be transported to a target site and containing (a) a built-in gas tank filled with pressurized gas, (b) means for opening said gas tank to discharge gas into the interior of the container, (c) a releasing device for actuating said gas tank opening means, (d) plural bags filled with different substances which when mixed form rigid plastics foam with a delayed hardening time at ambient temperatures and an accelerated hardening time at elevated temperatures, (e) a mixing chamber, (f) tubes initially closed by rupturable foils connecting said bags to said mixing chamber, (g) a tube with a venturi leading from the interior of said container to the mixing chamber, and (h) spray nozzles in the outer wall of said container connected to the mixing chamber by connecting tubes whereby when the releasing device actuates said opening means to release pressurized gas from the tank into the interior of said container, said bags are compressed to discharge their contents into the tubes connected to the mixing chamber, rupture the foils and flow into the mixing chamber, said pressurized gas also flowing through the venturi into the mixing chamber to act as a blowing agent and expel the plastics foam through the spray nozzles to act against enemy vehicles.

2. An apparatus as set forth in claim 1 wherein the bags are filled with substances which when mixed form plastics foams having variable delay times to harden.

3. An apparatus as set forth in claim 1 wherein the plastics foam is electrically conducting to disable electronic devices.

4. An apparatus as set forth in claim 1 wherein said container is buried in the soil as a land mine whereby the container is protected against the covering soil by a spring cover and an explosive charge disposed in said container for opening said cover to discharge the produced plastics foam.

5. An apparatus as set forth in claim 1 wherein said container is launched by an aerial missile to be used as an antiaircraft device whereby the plastics foam expelled through said spray nozzles forms a large cloud of small droplets adapted to be sucked into the air-inlet of a jet engine to block said engine because the high temperature therein rapidly accelerates the hardening process of the foam.

* * * * *